US007684731B2

(12) United States Patent
Hirose et al.

(10) Patent No.: US 7,684,731 B2
(45) Date of Patent: Mar. 23, 2010

(54) IMAGE FORMING APPARATUS WITH HINGE HOLES AND SPRING

(75) Inventors: Atsuo Hirose, Nagoya (JP); Wei Ming Wang, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 169 days.

(21) Appl. No.: 12/015,051

(22) Filed: Jan. 16, 2008

(65) Prior Publication Data

US 2008/0185943 A1 Aug. 7, 2008

(30) Foreign Application Priority Data

Feb. 7, 2007 (JP) ..... 2007-028115

(51) Int. Cl.
*G03G 21/00* (2006.01)

(52) U.S. Cl. ..... 399/124

(58) Field of Classification Search ..... 399/107, 399/110, 114, 124, 125; 347/152; 220/254.1, 220/254.3, 254.5, 827, 810, 843, 844, 836; 16/239, 362; 312/326–329, 319.2
See application file for complete search history.

(56) References Cited

U.S. PATENT DOCUMENTS 7,245,855 B2 7/2007 Yasumoto
7,430,385 B2 * 9/2008 Yamaoka ..... 399/110
2005/0281594 A1 12/2005 Fukuchi et al.
2007/0147882 A1 * 6/2007 Igarashi ..... 399/110
2008/0025001 A1 * 1/2008 Igarashi et al. ..... 361/726

FOREIGN PATENT DOCUMENTS

| | | |
|---|---|---|
| JP | 05-006040 | 1/1993 |
| JP | 06-059521 | 3/1994 |
| JP | 07-199568 | 8/1995 |
| JP | 08-044131 | 2/1996 |
| JP | 2005-011054 | 1/2005 |
| JP | 2005-283921 | 10/2005 |
| JP | 2005-297278 | 10/2005 |
| JP | 2006-003735 | 1/2006 |
| JP | 2006-106134 | 4/2006 |

* cited by examiner

*Primary Examiner*—David M Gray
*Assistant Examiner*—Gregory H Curran
(74) *Attorney, Agent, or Firm*—Banner & Witcoff, Ltd

(57) ABSTRACT

An image forming apparatus is described as including a door member for opening and closing an opening provided in a main body member; a hinge mechanism; and a lock mechanism. The hinge mechanism may include a first hinge hole and a second hinge hole which are provided in at least one of the door member and the main body member, and are arranged substantially coaxially while being spaced from each other, a hinge shaft inserted across the first hinge hole and the second hinge hole, and a spring unit which presses the hinge shaft against inner peripheral surfaces of the first and second hinge holes. The first hinge hole may be smaller in size than the second hinge hole.

7 Claims, 16 Drawing Sheets

LEFT

RIGHT

LEFT

RIGHT

LEFT

RIGHT

IMAGE FORMING APPARATUS WITH HINGE HOLES AND SPRING

CROSS REFERENCE TO RELATED APPLICATION

The present application claims a priority from Japanese Patent Application No. 2007-028115, which was filed on Feb. 7, 2007, the disclosures of which are herein incorporated by reference in its entirety.

TECHNICAL FIELD

The present invention relates to an image forming apparatus, and in particular, is effectively applied to an electrophotographic image forming apparatus (laser printer).

BACKGROUND

For example, inside the laser printer, an image forming unit including an exposure device (scanner), a transfer device (process cartridge), and a fixing unit, etc., is housed. For removal of a recording medium such as a recording sheet or an OHP sheet jammed inside the laser printer or maintenance of the transfer device, etc., the main body member in which the image forming unit is housed is normally provided with an opening for maintenance and a door member (opening and closing cover) for opening and closing this opening, and this door member is fitted to the main body member via hinge mechanisms (for example, refer to Patent Document 1).

[Patent document 1] Japanese Published Unexamined Patent Application No. H08-44131

SUMMARY

When the door member is fitted to the main body member via hinge mechanisms, normally, lock mechanisms for holding a closed state of the door member are provided at positions deviated from the hinge mechanisms.

Normally, the hinge mechanism is formed so as to have a hinge shaft and hinge holes into which the hinge shaft is inserted. By making the hinge holes larger than the hinge shaft, dimensional variation between the door member and the main body member is absorbed and the door member is reliably locked by the lock mechanisms, and the hinge shaft can easily slide and rotate with respect to the hinge holes.

However, if the hinge holes are made larger than the hinge shaft to absorb the dimensional variation, even when the door member is closed, the door member rattles due to rattling of the hinge mechanisms themselves. The inventors considered and manufactured by trial new hinge mechanisms whose rattling was reduced by providing springs which pressed the hinge shafts against the inner peripheral surfaces of the hinge holes, and the following new problem occurred.

The lock mechanisms hold a closed state of the door member by applying a holding force to the door member and the main body member so as to relatively draw the door member toward the main body member, so that in the image forming apparatus relating to the above-described trial and consideration, a holding force of the lock mechanisms and an elastic force of the springs are applied to the door member.

In this case, in the image forming apparatus relating to the above-described trial and consideration, the door member is provided on the front face side of the main body member, and for layout of other equipment, the lock mechanism and the hinge mechanism are inevitably arranged so as to be deviated from each other in a direction (horizontal direction) parallel to the hinge shaft, so that a bending moment is applied to the door member, and the door member warps.

In other words, if the lock mechanism and the hinge mechanism are arranged so as to be deviated from each other, a bending moment is applied to the door member, so that the door member warps.

The above-described problem is caused by the arrangement of the lock mechanism and the hinge mechanism deviated from each other, so that this problem occurs when the lock mechanism and the hinge mechanism are deviated from each other in the direction parallel to the hinge shaft not only when the door member is provided on the front face or a side surface of the main body member, but also when the door member is provided on the upper face side of the main body member.

In view of this problem, an object of the present invention is to suppress great warping of the door member while absorbing the dimensional variation between the door member and the main body member.

In order to achieve the above-described object, according to one of the aspects of the present invention, an image forming apparatus is equipped with: an image forming unit which forms an image on a recording medium; a main body member which includes a main body frame supporting the image forming unit and a casing covering the main body frame, and houses the image forming unit; a door member for opening and closing an opening provided in the main body member; hinge mechanisms which swingably join the door member with respect to the main body member; and lock mechanisms which are provided at positions deviated from the hinge mechanisms and hold a state that the door member is closed, wherein the hinge mechanism includes; a first hinge hole and a second hinge hole which are provided in at least one of the door member and the main body member, and are arranged substantially coaxially while being spaced from each other, a hinge shaft inserted across the first hinge hole and the second hinge hole, and a spring unit which presses the hinge shaft against inner peripheral surfaces of the first and second hinge holes, and furthermore, the first hinge hole is smaller in size than the second hinge hole.

Accordingly, the second hinge hole is larger than the first hinge hole, so that dimensional variation between the door member and the main body member can be effectively absorbed by the second hinge hole. On the other hand, the first hinge hole is smaller than the second hinge hole, so that displacement (movement) of the door member is restricted by the first hinge hole, and the door member is suppressed from greatly warping.

The above-described problem can be solved by sufficiently increasing the rigidity of the door member, however, this solution makes the door member heavy and increases the manufacturing cost of the door member.

On the other hand, according to the one of the aspects of the present invention, while the weight increase and the manufacturing cost increase of the door member are suppressed and the dimensional variation between the door member and the main body member is absorbed, the door member can be suppressed from greatly warping.

BRIEF DESCRIPTION OF THE DRAWINGS

Illustrative aspects of the invention will be described in detail with reference to the following figures wherein.

DETAILED DESCRIPTION OF THE PREFERED EMBODIMENTS

In the present embodiment, the image forming apparatus of the present invention is applied to an electrophotographic image forming apparatus (laser printer). Hereinafter, an image forming apparatus of this embodiment will be described with reference to the drawings.

Figure 1:
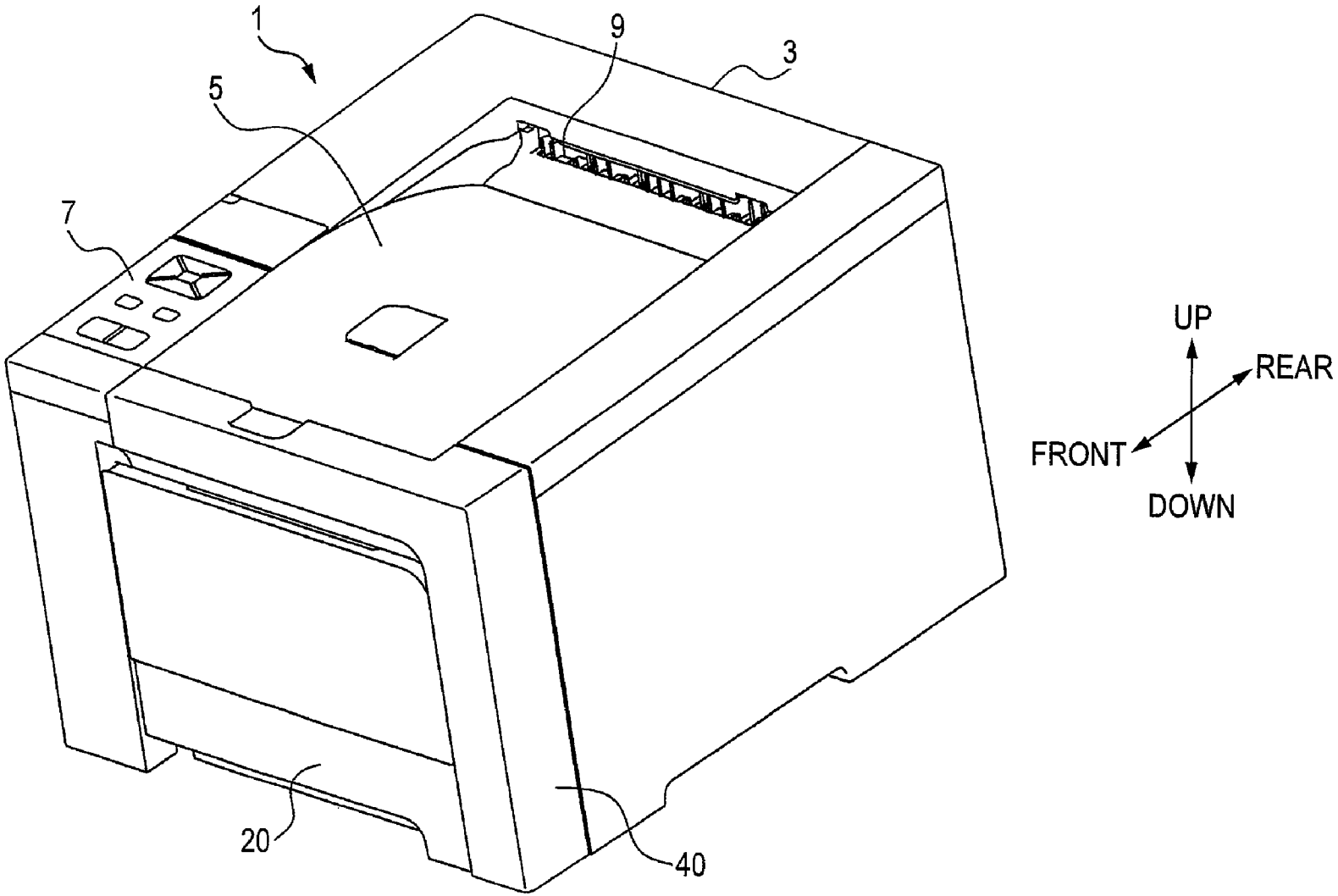
FIG. 1 is an external perspective view of a laser printer 1 of an embodiment.
Figure 2:
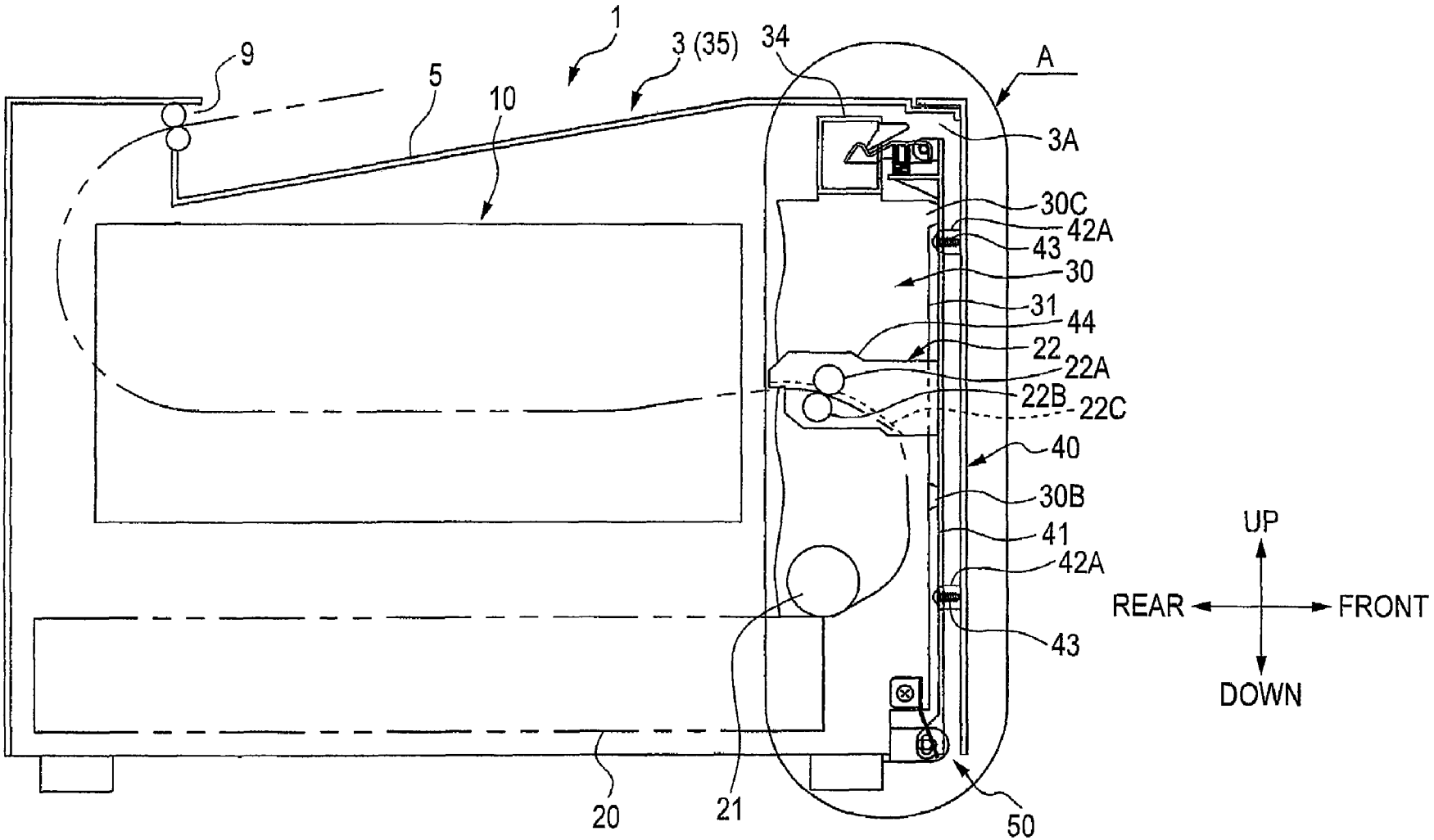
FIG. 2 is a general sectional view cut on a vertical section of the laser printer 1 of the embodiment of the invention.
Figure 3:
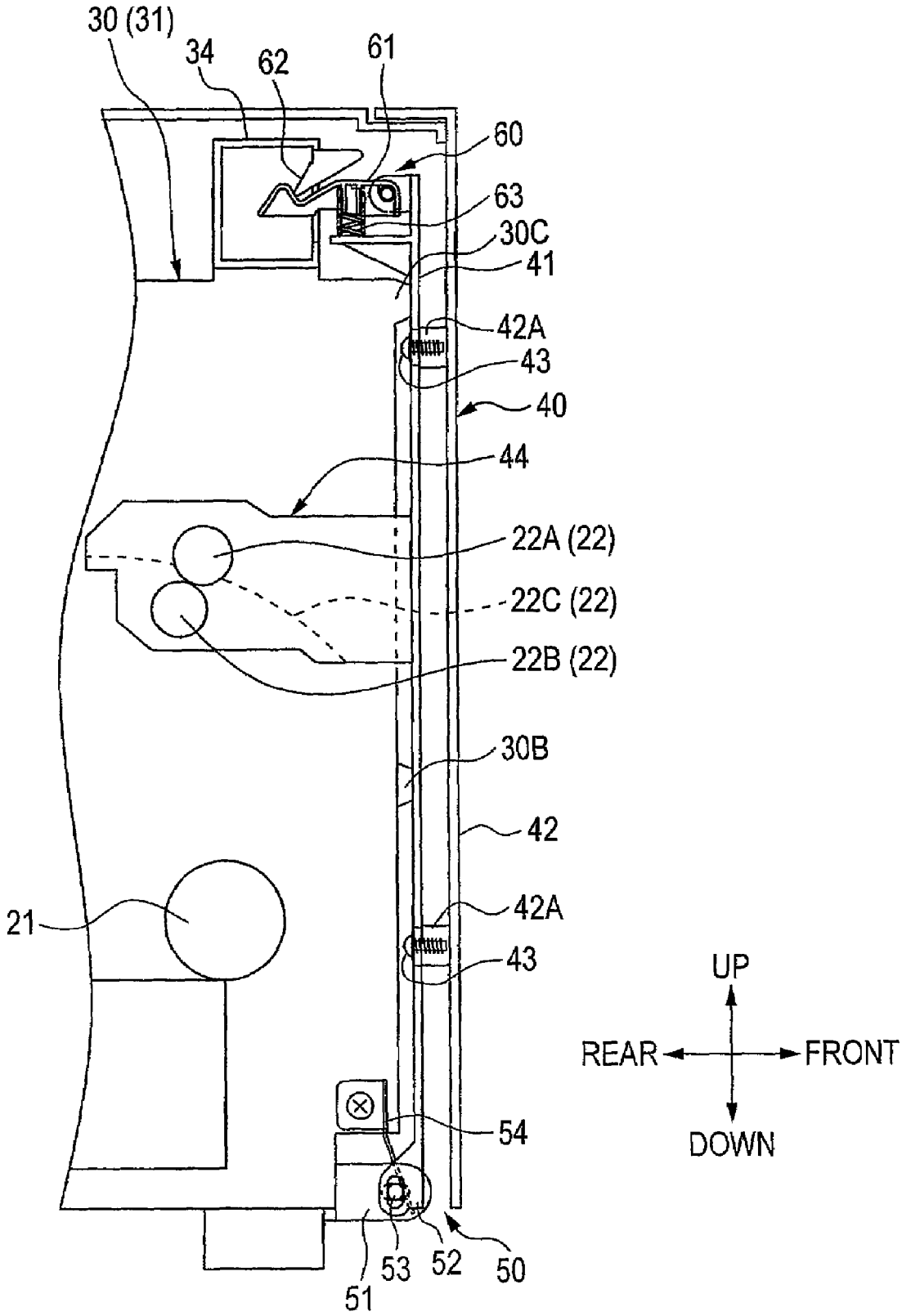
FIG. 3 is an enlarged view of the portion A of FIG. 2.
Figure 4:
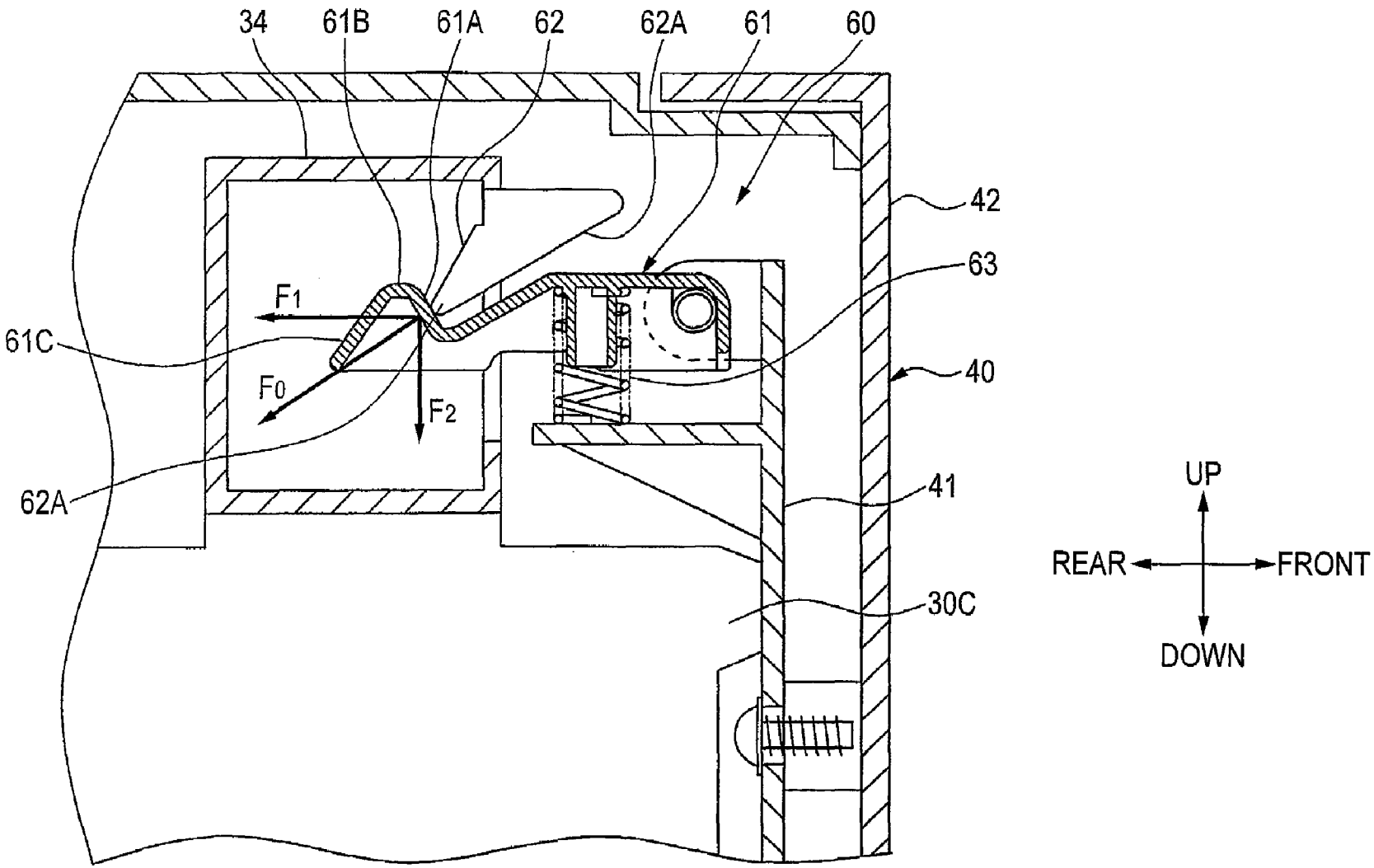
FIG. 4 is an enlarged view of the lock mechanism 60 of the embodiment of the present invention.

FIG. 1 is an external perspective view of a laser printer 1 of this embodiment, FIG. 2 is a general sectional view cut on a vertical section of the laser printer 1, FIG. 3 is an enlarged view of the portion A of FIG. 2, and FIG. 4 is an enlarged view of a lock mechanism 60.

Figure 5:
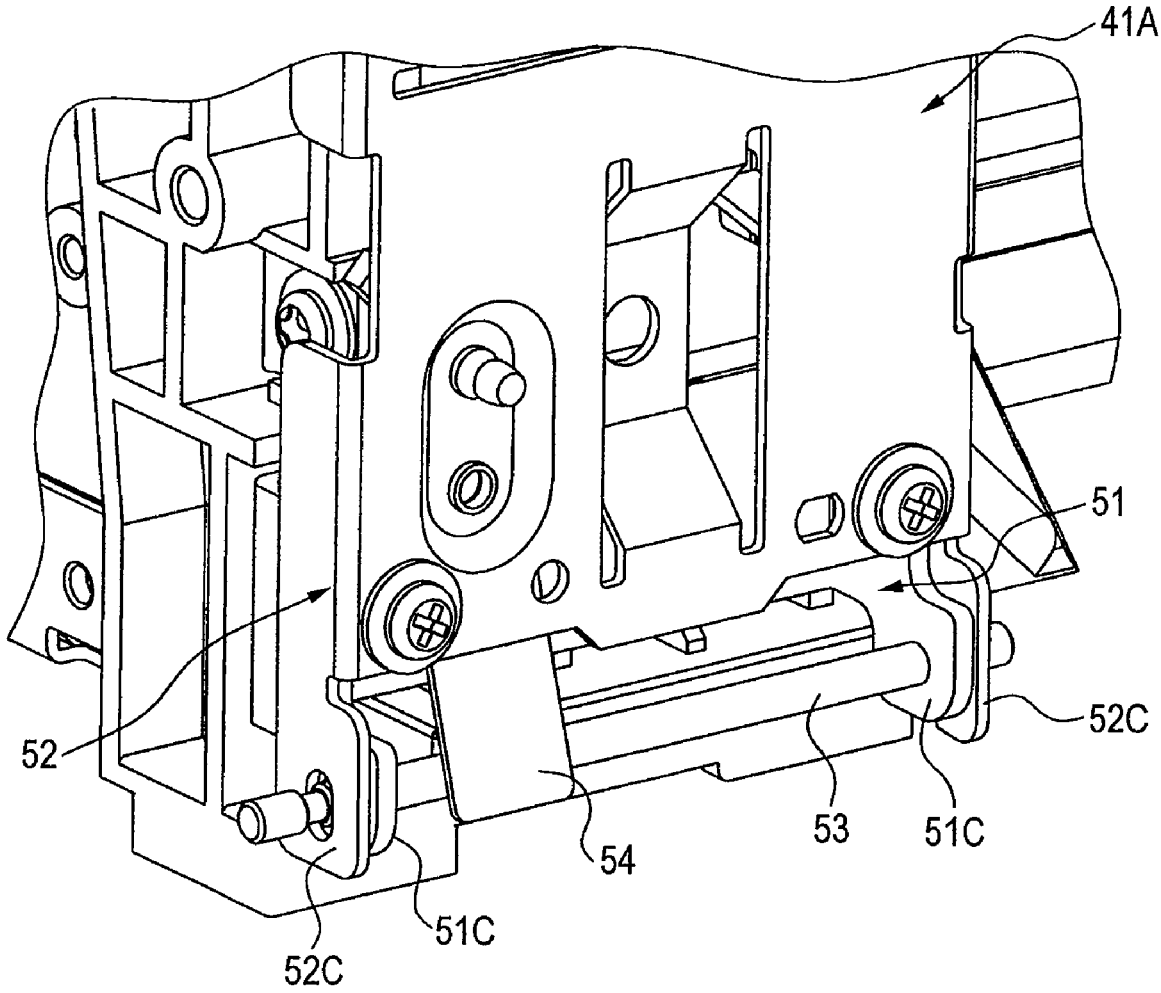
FIG. 5 is an enlarged perspective view of a left hinge mechanism 50 of the embodiment of the present invention.
Figure 6:
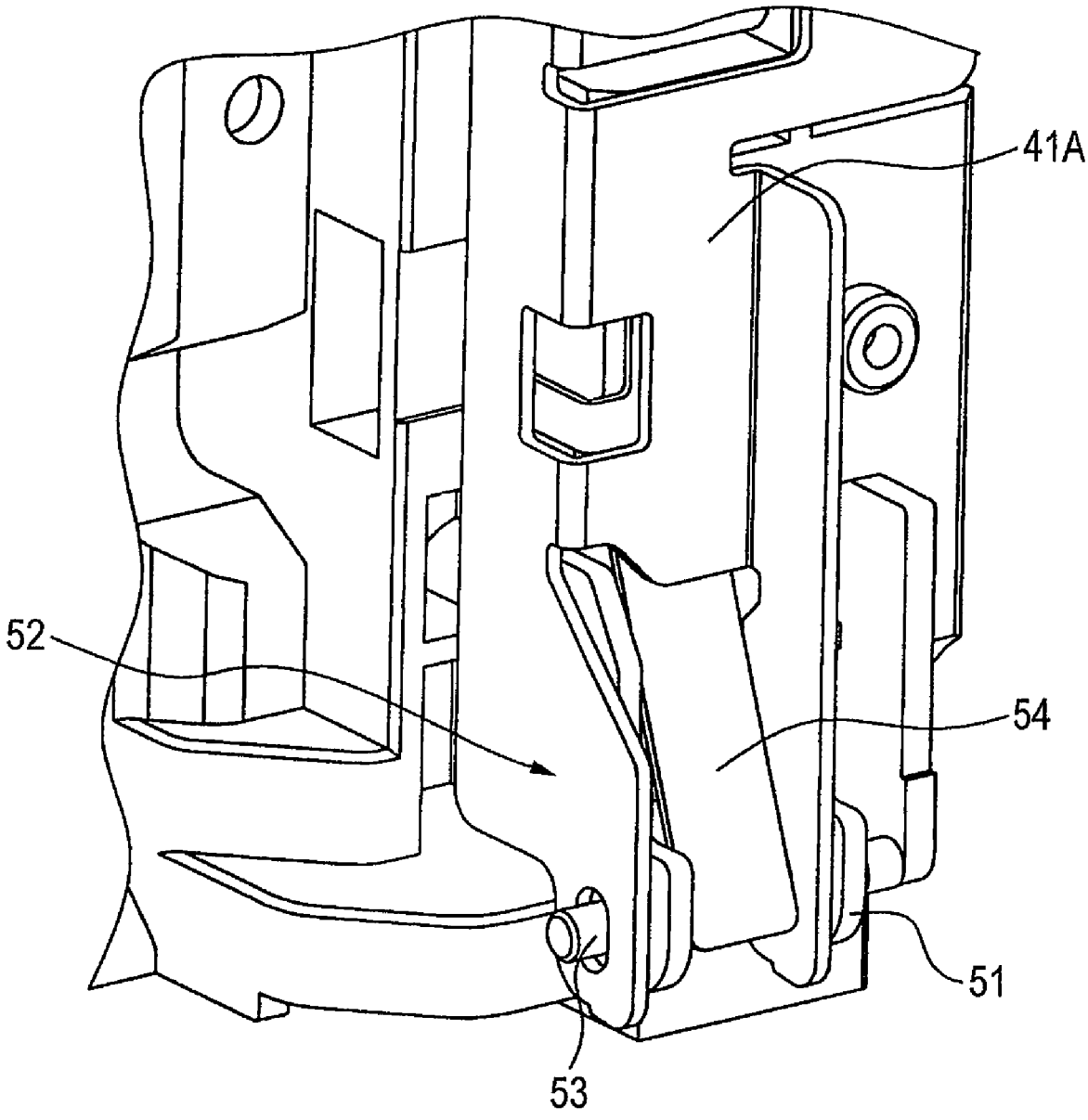
FIG. 6 is an enlarged perspective view of a right hinge mechanism 50 of the embodiment of the present invention.
Figure 7:
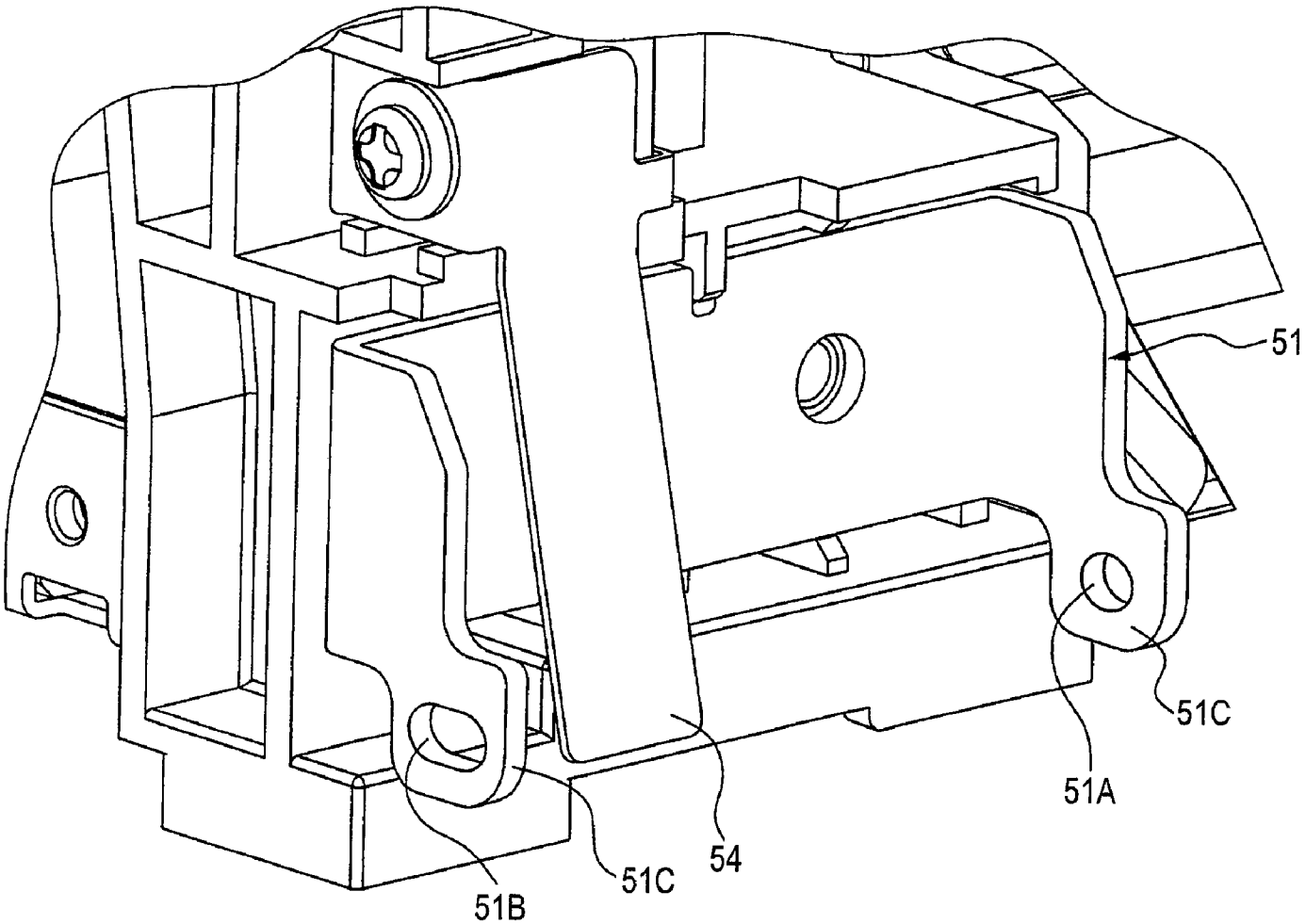
FIG. 7 is a perspective view showing left main body hinge plate 51 and hinge spring 54 of the embodiment of the present invention.
Figure 8:
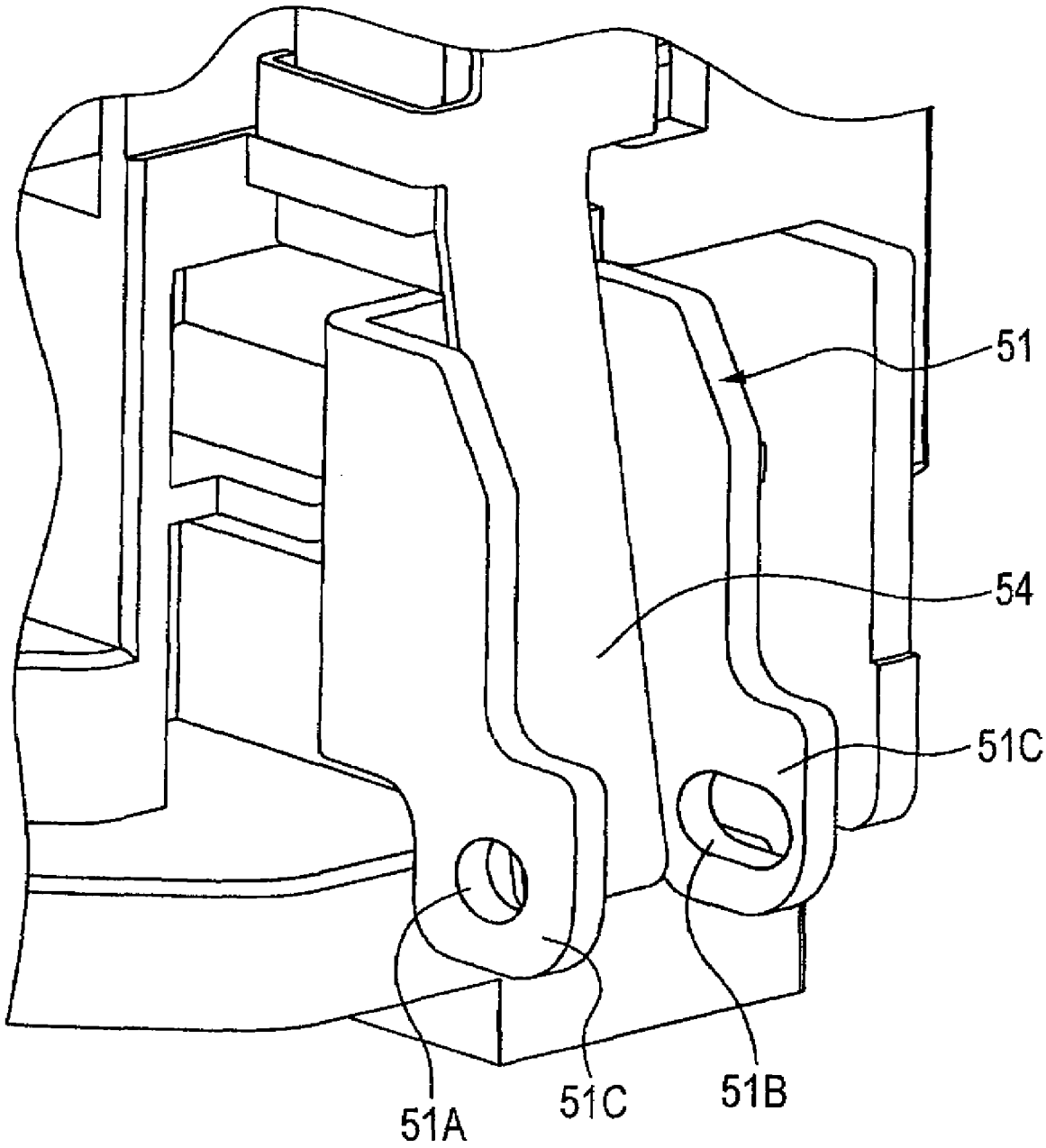
FIG. 8 is a perspective view showing right main body hinge plate 51 and hinge spring 54 of the embodiment of the present invention.
Figure 9:
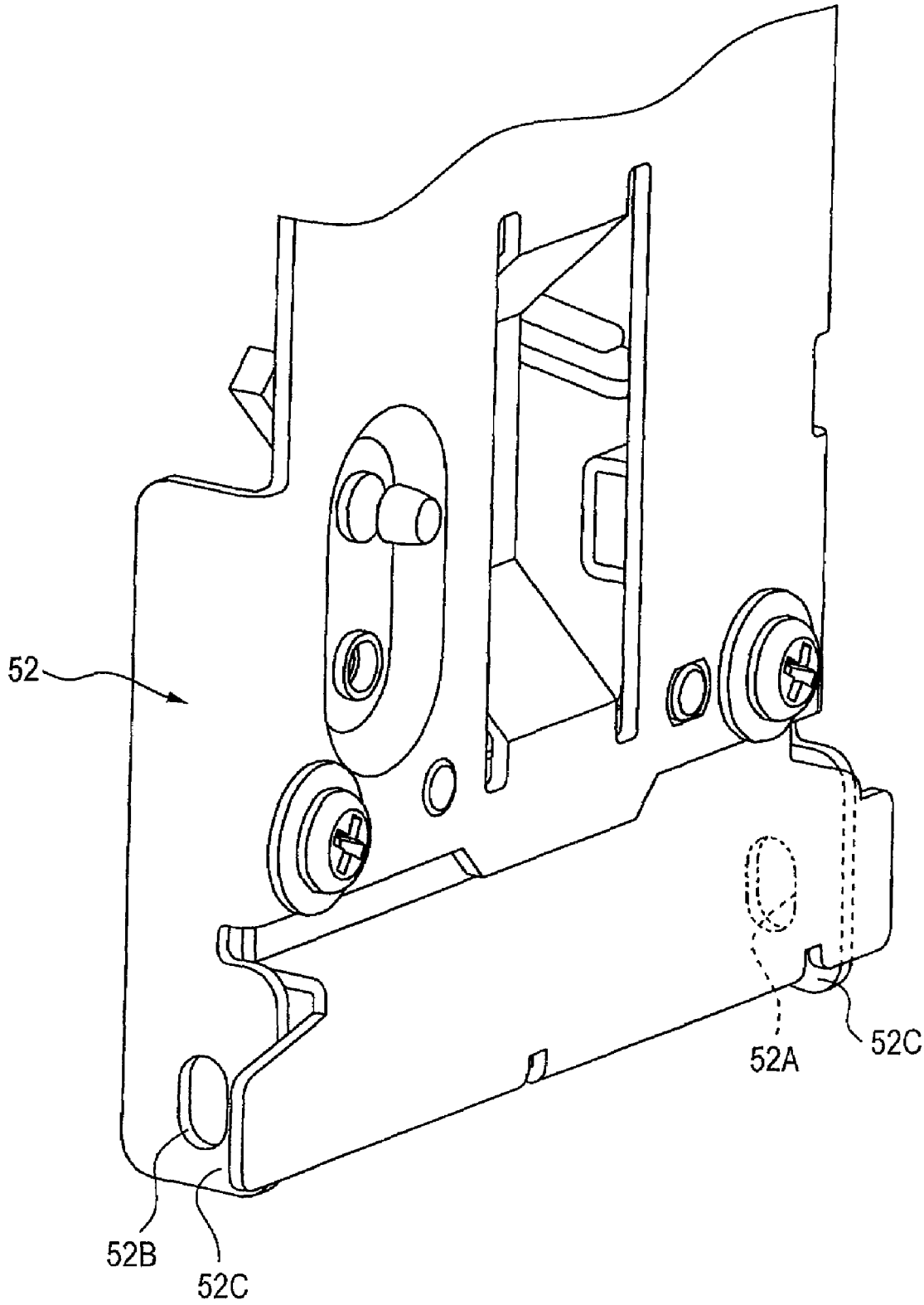
FIG. 9 is a perspective view showing a left door hinge plate 52 of the embodiment of the present invention.
Figure 10:
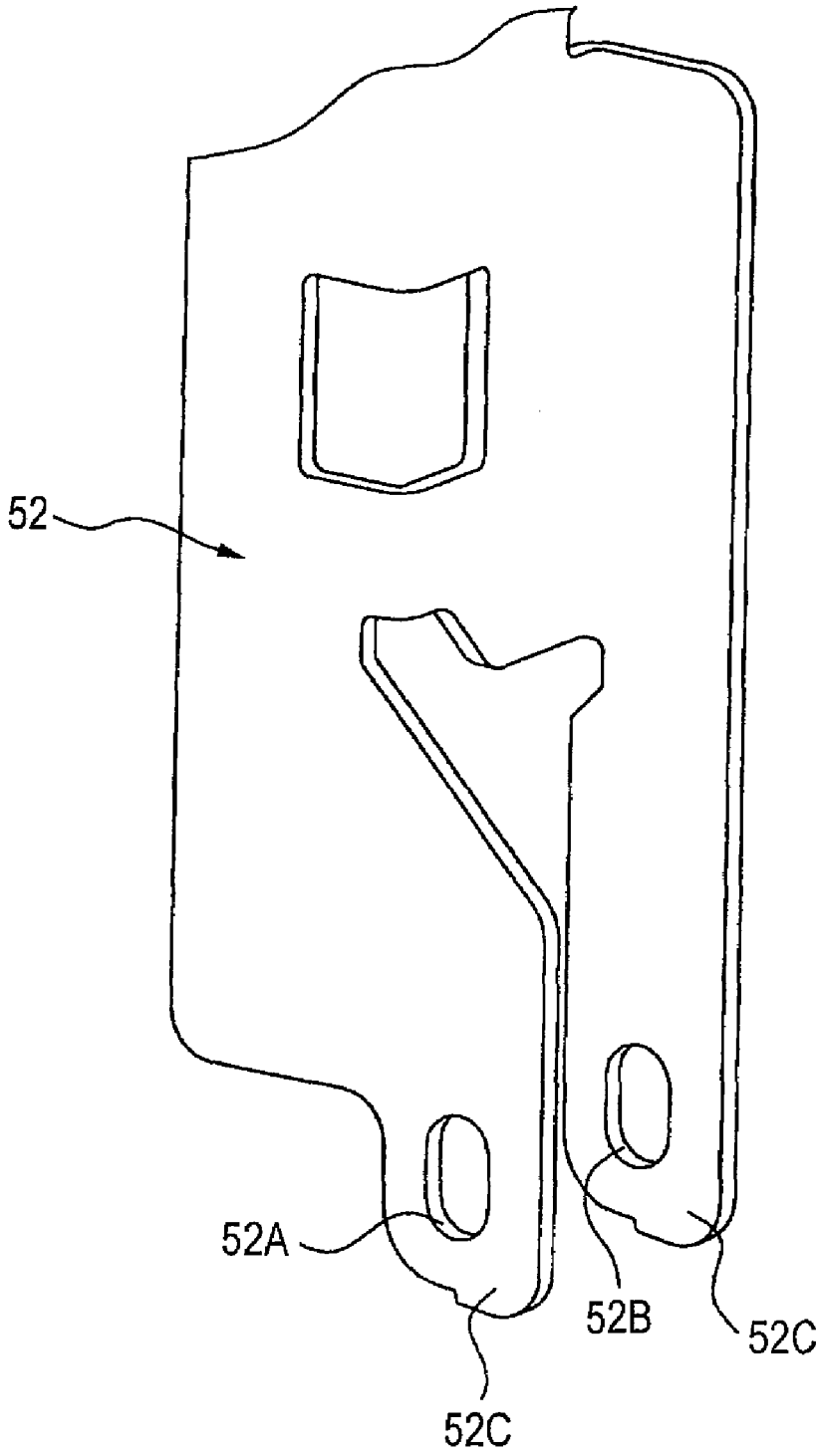
FIG. 10 is a perspective view showing a right door hinge plate 52 of the embodiment of the present invention.
Figure 11:
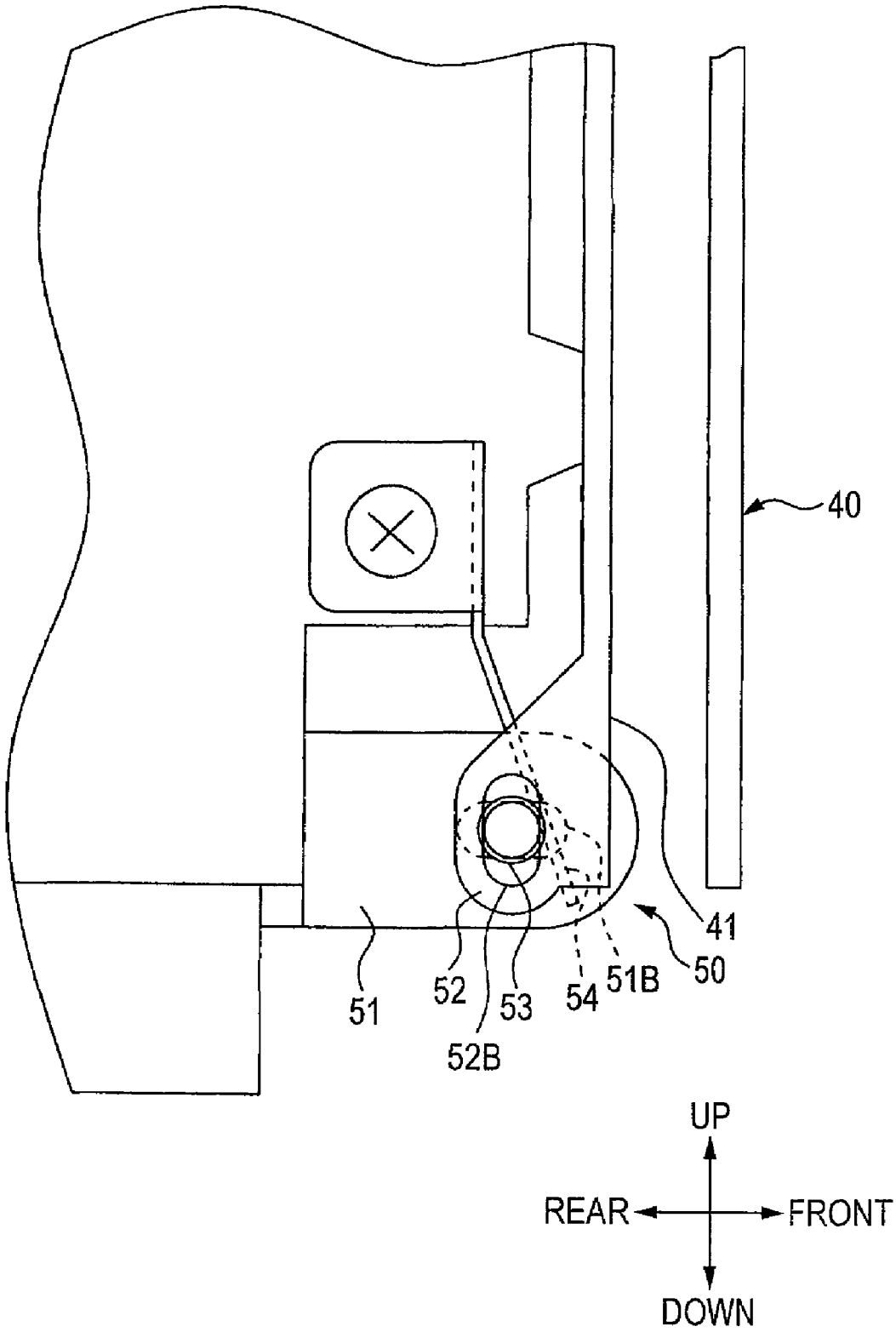
FIG. 11 is an enlarged side view of a hinge mechanism 50 of the embodiment of the present invention.

FIG. 5 and FIG. 6 are enlarged perspective views of a hinge mechanism 50, FIG. 7 and FIG. 8 are perspective views showing a main body hinge plate 51 and a hinge spring 54, FIG. 9 and FIG. 10 are perspective views showing a door hinge plate 52, and FIG. 11 is an enlarged side view of a hinge mechanism 50.

Figure 12:
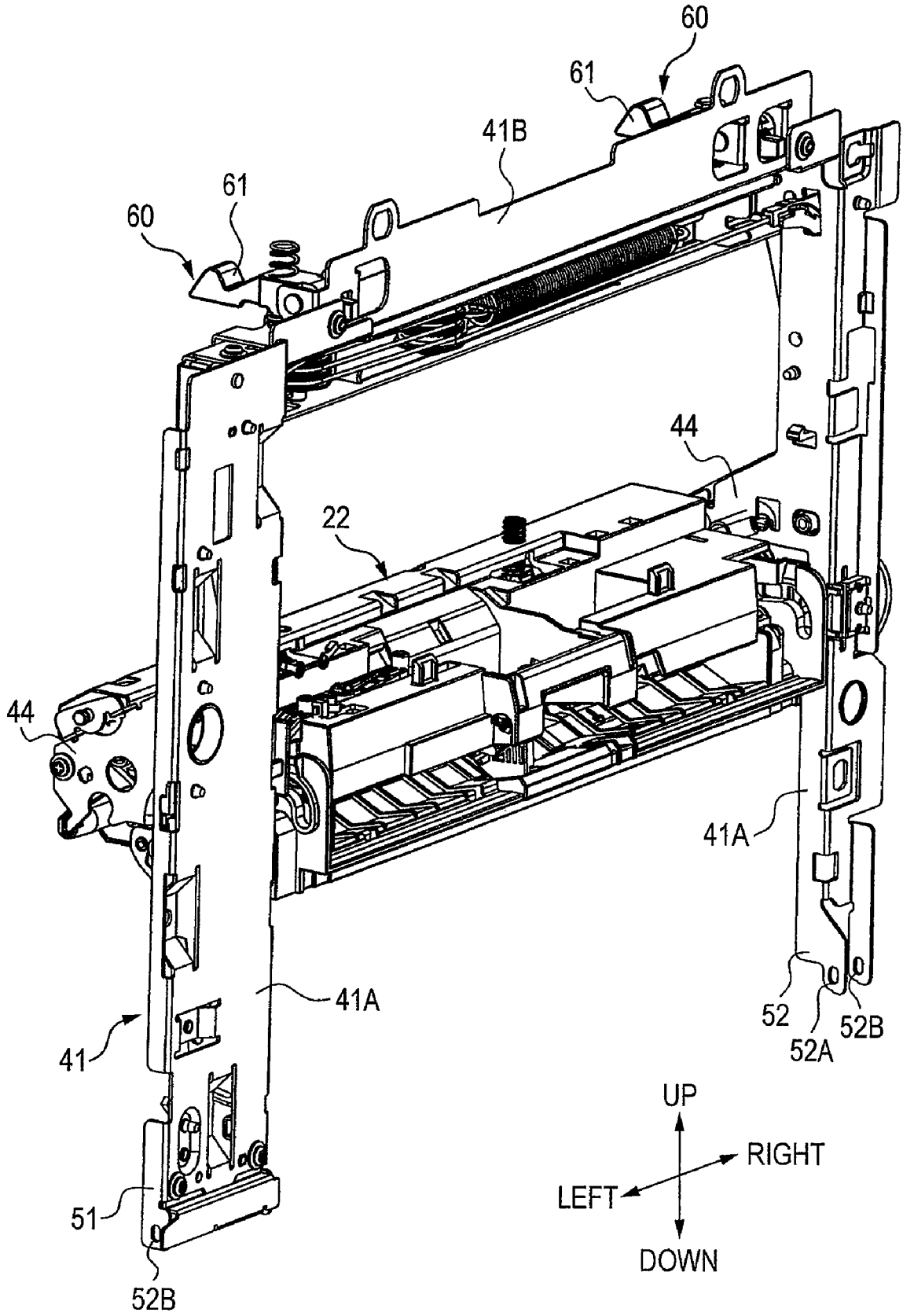
FIG. 12 is a perspective view showing a door frame 41 and a conveying chute 22C of the embodiment of the present invention.
Figure 13:
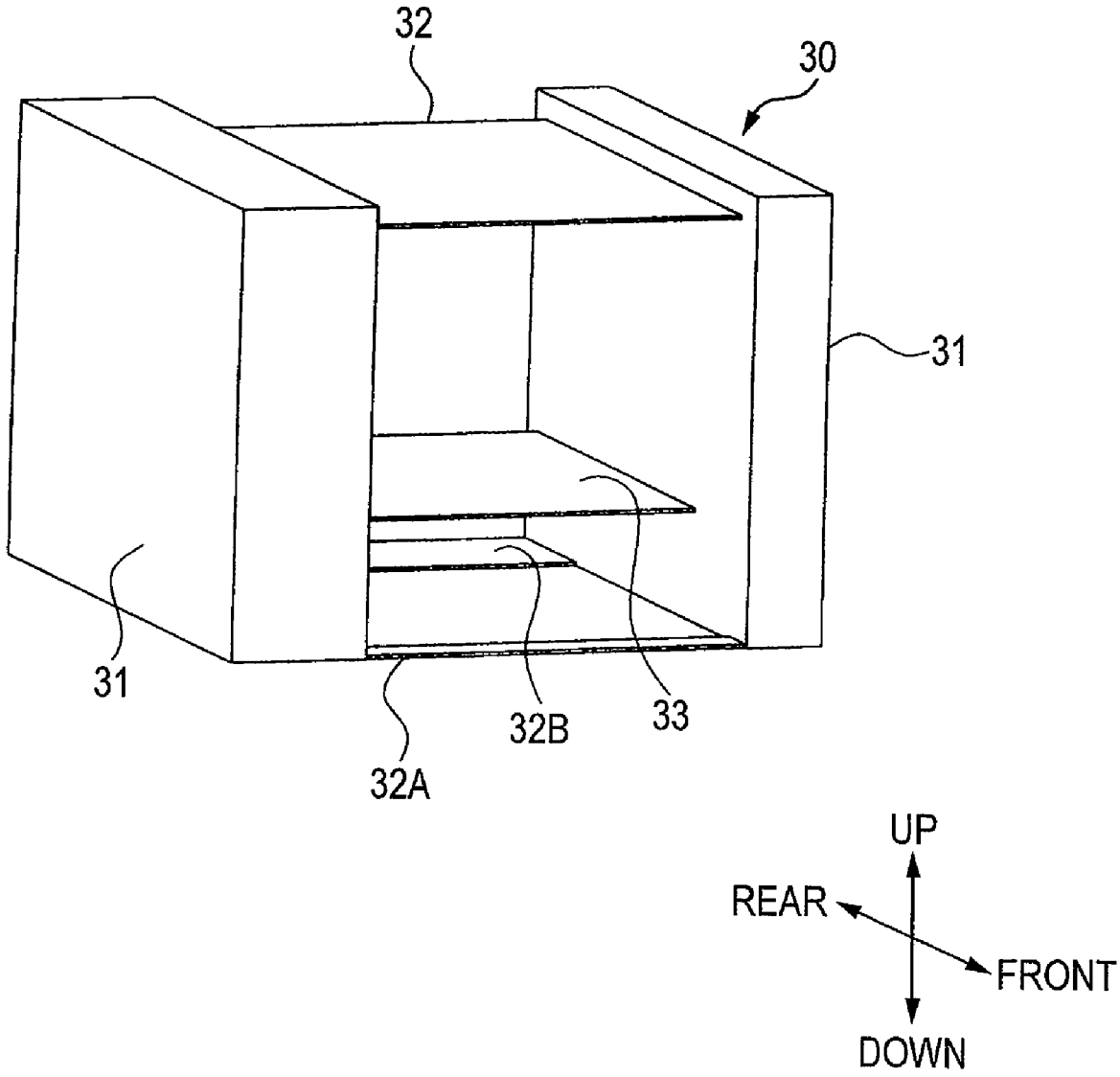
FIG. 13 is a perspective view of a main body frame 30 of the embodiment of the present invention.
Figure 14:
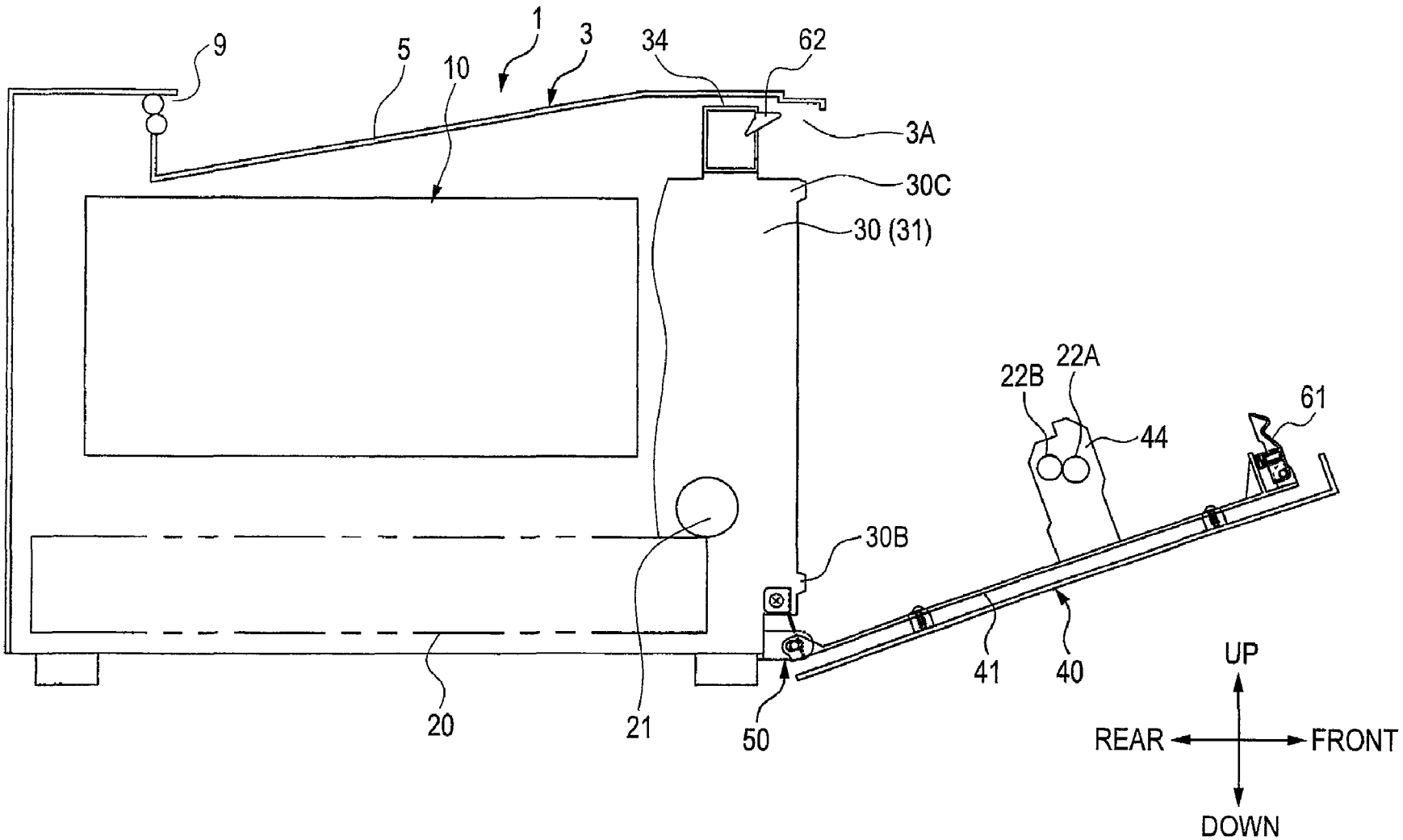
FIG. 14 is a view showing a state that an opening and closing door 40 is opened in FIG. 2.
Figure 15:
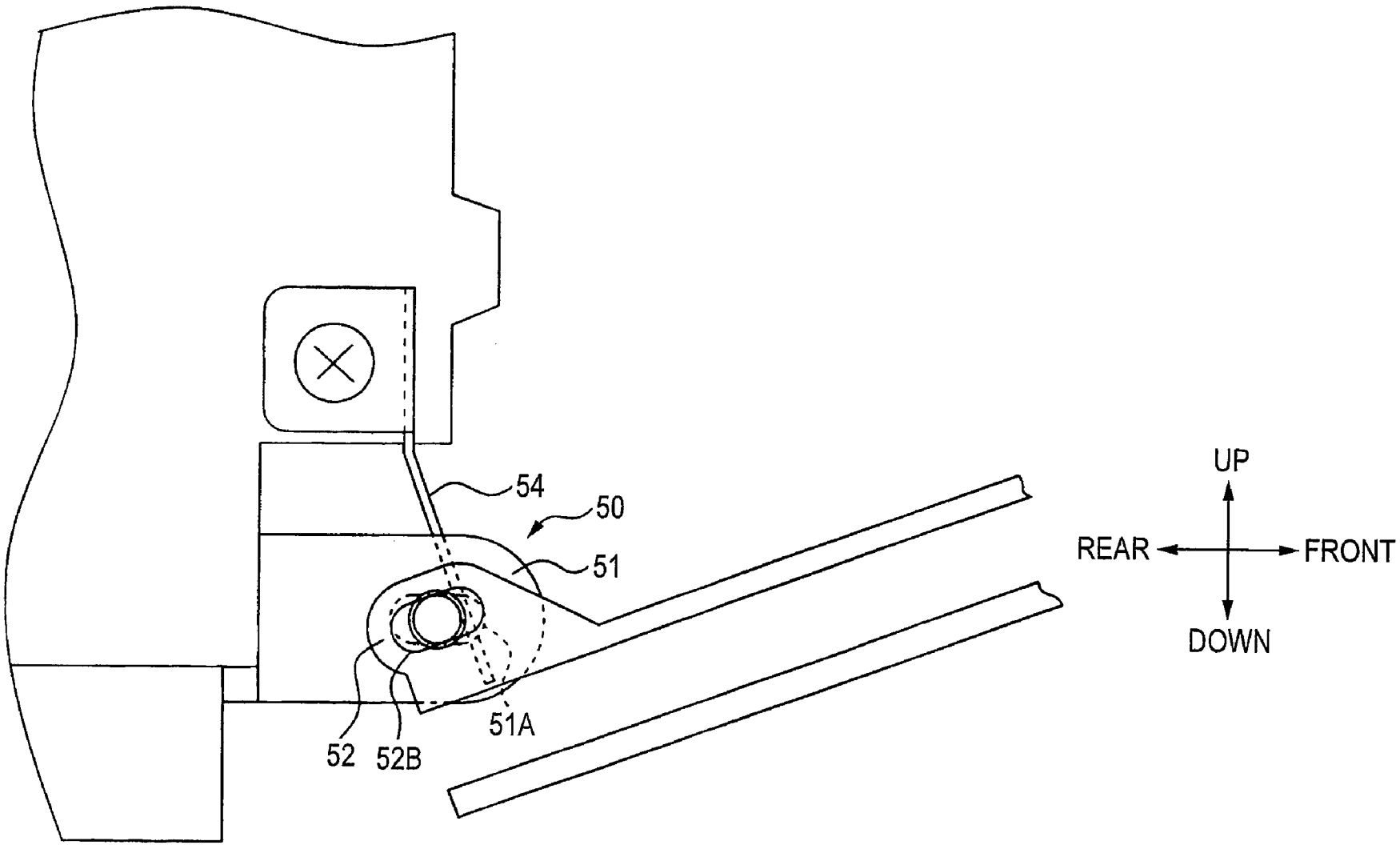
FIG. 15 is an enlarged side view of the hinge mechanism 50 in the state that the opening and closing door 40 is opened.
Figure 16:
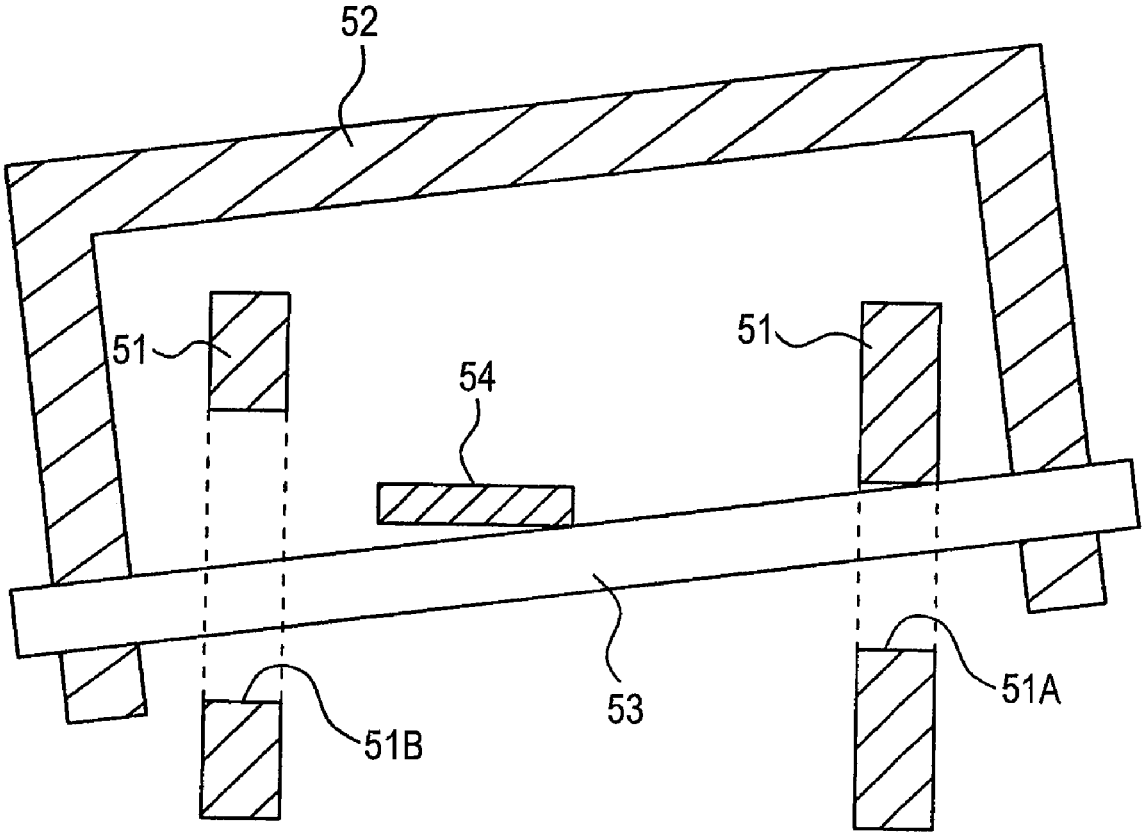
FIG. 16 is a view showing a relationship between a hinge spring 54 and a hinge shaft 53 of the embodiment of the present invention.

FIG. 12 is a perspective view showing a door frame 41 and a conveying chute 22C, FIG. 13 is a perspective view of a main body frame 30, FIG. 14 is a view showing a state that an opening and closing door 40 is opened in FIG. 2, FIG. 15 is an enlarged side view of the hinge mechanism 50 in the state that the opening and closing door 40 is opened, and FIG. 16 is a view showing a relationship between a hinge spring 54 and a hinge shaft 53.

1. Constitution of Laser Printer 1

1-1. General Constitution of Laser Printer 1

A laser printer 1 of this embodiment is used by setting the front side of the sheet of FIG. 1 as the front face side. A sheet discharging tray 5 having recording medium placed thereon such as recording sheets on which the image forming has been finished, and an operation panel 7 for setting-operating the laser printer 1 are provided on the upper surface of a casing 3. A discharging unit 9 for discharging the recording medium on which the image forming has been finished is provided on the rear end side of the sheet discharging tray 5.

Inside the casing 3, as shown in FIG. 2, an electrophotographic image forming unit 10, a sheet feed tray 20 on which recording medium to be conveyed to the image forming unit 10 are placed, etc., are disposed, and the image forming unit 10 and the sheet feed tray 20 are detachably fitted to a main body frame 30 provided inside the casing 3. In this embodiment, a main body 35 is constituted by the main body frame 30 and the casing 3 covering the main body frame 30.

As shown in FIG. 13, the main body frame 30 includes side frames 31 provided on both horizontal sides orthogonal to a conveying direction of the recording medium, a top plate 32 which joins upper ends of the side frames 31, first bottom plate 32A and second bottom plate 32B which join the lower ends of the side frames 31, etc.

Between the top plate 32 and the first and second bottom plates 32A and 32B, a support plate 33 joined to both side frames 31 so as to support the image forming unit 10, etc., is provided. On the other hand, on the front upper side of the main body frame 30, as shown in FIG. 2, a pipe-shaped reinforcing member 34 which joins both side frames 31 is provided.

The reinforcing member 34, the top plate 32, and the first and second bottom plates 32A and 32B, etc., are made of metal such as SPCC (cold rolled steel plate), and main portions of the side frames 31 are made of a resin with excellent mechanical strength such as ABS or a polymer alloy, and then reinforced by a metal plate such as SPCC. The side frames 31, the reinforcing member 34, the top plate 32, and the first and second bottom plates 32A and 32B, etc., are joined and fixed to each other by a mechanical fastening unit such as P screws (not shown).

An opening 3A is provided on a horizontal end side of the casing 3. This opening 3A is opened and closed by an opening and closing door 40. The opening and closing door 40 is swingably fitted to the main body 35 (in this embodiment, side frames 31) via the hinge mechanisms 50.

The opening 3A is for attachment and detachment of a process cartridge forming a part of the image forming unit 10 and for removal of a recording medium jammed inside the casing 3 (laser printer 1), etc. In this embodiment, the opening 3A is provided on the front side (right side in FIG. 2) of the laser printer 1.

1-2. Image Forming Unit

The image forming unit 10 forms an image on a recording medium conveyed from the sheet feed tray 20. In detail, the image forming unit 10 includes a process cartridge which is disposed above the sheet feed tray 20 and contains a photosensitive drum and a developer (toner), an exposure device (scanner) which is disposed above the process cartridge and forms an electrostatic latent image by exposing the photosensitive drum, a transfer unit which is disposed at a position opposing the photosensitive drum and transfers a developer image formed on the photosensitive drum onto the recording medium, and a fixing unit which fixes the developer transferred on the recording medium on the recording medium by heating the same, etc.

1-3. Conveyance Mechanism

As shown in FIG. 2 and FIG. 3, a conveying roller 21 is disposed above the sheet feed tray 20 and applies a conveying force to a recording medium placed on the sheet feed tray 20. The conveying direction of a recording medium to which a conveying force is applied from the conveying roller 21 is turned by substantially 90 degrees upward by a first guide mechanism such as a guide roller (not shown). And then, the conveying direction of the recording medium is turned by substantially 90 degrees into the horizontal direction by the second guide mechanism 22. As described above, the recording medium is conveyed to the image forming unit 10.

The second guide mechanism 22 is a conveyance guide unit including a registration roller (hereinafter, referred to as a registration roller 22A) which controls (adjusts) the conveying direction of the recording medium by sandwiching the recording medium by a pair of rollers 22A and 22B, and a conveying chute 22C which guides conveyance of the recording medium. This second guide mechanism 22 is fixed to a door frame 41 described later.

1-4. Opening and Closing Door (see FIG. 2, FIG. 3, and FIG. 12)

As shown in FIG. 3, the opening and closing door 40 includes a door frame 41 which forms a framework of the opening and closing door 40 and a door cover 42 which forms a design surface by covering the outside of the door frame 41. The door frame 41 is integrated with the door cover 42 by fixing a mechanical fastening unit such as P screws 43 to protruding bosses 42A formed on the door cover 42.

As shown in FIG. 12, the door frame 41 is a gate-like frame including two post frames 41A arranged at positions corresponding to the side frames 31 of the main body 35 and a beam frame 41B which joins one longitudinal ends (upper ends of FIG. 12) of the two post frames 41A. In this embodiment, the post frames 41A and the beam frame 41B are made of metal (for example, SPCC), and these frames 41A and 41B are joined by a mechanical fastening unit such as screws or welding.

As shown in FIG. 2 and FIG. 3, arms 44 supporting the second guide mechanism 22 are provided on the door frame 41 (post frames 41A). Vertical positioning portions (not shown), which come into contact with positioning contact surfaces (not shown) provided on the main body frame 30 from vertically upper sides, are provided on the arms 44. The position of the opening and closing door 40 with respect to the main body frame 30 (main body 35) in the vertical direction is determined by contact of the vertical positioning portions 45 with the contact surfaces from the vertical direction.

In the main body frame 30 (side frame 31), a first main body side contact portion 30B is a positioning contact surface which is provided closer to the hinge mechanism 50 side than the arm 44. In the main body frame 30 (side frame 31), a second main body side contact portion 30C is a positioning contact surface on the opposite side of the first main body side contact portion 30B across the arm 44.

The first main body side contact portion 30B and the second main body side contact portion 30C come into contact with the door frame 41 (post frames 41A) from the horizontal direction, whereby the position of the opening and closing door 40 with respect to the main body frame 30 (main body 35) in the front and rear direction is determined.

The position of the opening and closing door 40 with respect to the main body frame 30 (main body 35) in the width direction (left and right direction) is determined according to pressing of the arms 44 or the door frame 41 against either the left or right side frame 31 side by pressing members (not shown) provided on the arms 44 or the side frames 31. The pressing forces of the pressing members are provided by elastic member such as springs.

1-5. Hinge Mechanism (see FIG. 5 through FIG. 11)

As shown in FIG. 5 and FIG. 6, the hinge mechanism 50 includes a metal-made main body hinge plate 51 fixed to the main body 35 (side frames 31), a metal-made door hinge plate 52 provided on the opening and closing door 40 (post frames 41A), a metal-made hinge shaft 53 which joins the plates 51 and 52 to each other swingably, etc.

As shown in FIG. 7 and FIG. 8, a first hinge hole 51A and a second hinge hole 51B, which are arranged substantially coaxially while being spaced from each other in the horizontal direction (in this embodiment, left and right direction), are formed in the main body hinge plate 51. Similarly, as shown in FIG. 9 and FIG. 10, a first hinge hole 52A and a second hinge hole 52B, which are arranged substantially coaxially while being spaced from each other in the horizontal direction (in this embodiment, left and right direction), are formed in the door hinge plate 52.

Hereinafter, the first hinge hole 51A is referred to as a first main body hinge hole 51A, the second hinge hole 51B is referred to as a second main body hinge hole 51B, the first hinge hole 52A is referred to as a first door hinge hole 52A, and the second hinge hole 52B is referred to as a second door hinge hole 52B.

The first main body hinge hole 51A and the second main body hinge hole 51B are collectively referred to as main body hinge holes, the first door hinge hole 52A and the second door hinge hole 52B are collectively referred to as door hinge holes, and the main body hinge holes and the door hinge holes are collectively referred to as hinge holes.

As shown in FIG. 7 and FIG. 8, the second main body hinge hole 51B is formed into a slot so that its long diameter direction coincides with the horizontal direction (in this embodiment, front and rear direction). On the other hand, the first main body hinge hole 51A is formed into a hole smaller than the second main body hinge hole 51B. In detail, in this embodiment, the first main body hinge hole 51A is formed into a circular hole with a diameter equal to the short diameter of the second main body hinge hole 51B.

Therefore, the first main body hinge hole 51A formed as a circular hole is positioned at the side close to the lock mechanism 60 in the direction parallel to the axial direction of the hinge shaft 53. That is, the first main body hinge hole 51A is positioned at the side closer to the central side than the second main body hinge hole 51B in the left and right direction of the FIG. 12

Therefore, when the first main body hinge hole 51A, the second main body hinge hole 51B, and the lock mechanism 60 are projected in a direction parallel to the axial direction of the hinge shaft 53, they have an arrangement relationship in which the first main body hinge hole 51A is positioned between the second main body hinge hole 51B and the lock mechanism 60.

On the other hand, the door hinge holes (first door hinge hole 52A and second door hinge hole 52B) are formed into slots long in diameter in a direction substantially orthogonal to the long diameter direction of the second main body hinge hole 51B in the state that the opening and closing door 40 is closed as shown in FIG. 5, FIG. 6, FIG. 9, and FIG. 10.

Therefore, in this embodiment, as shown in FIG. 14 and FIG. 15, when the opening and closing door 40 is opened, the long diameter direction of the door hinge holes come close to the direction parallel to the long diameter direction of the second main body hinge hole 51B.

As shown in FIG. 5 and FIG. 6, the hinge shaft 53 is inserted into the main body hinge holes and the door hinge holes so as to be laid across the first main body hinge hole 51A and the second main body hinge hole 51B, and across the first door hinge hole 52A and the second door hinge hole 52B. In this case, the hinge shafts 53, the main body hinge holes and door hinge holes can be relatively rotated and displaced in a sliding manner.

A stopper unit, which prevents the hinge shaft from coming-off the main body hinge holes and the door hinge holes, is provided on the hinge shaft 53. Two stays 51C, in which the main body hinge holes are made, are positioned between two stays 52C in which the door hinge holes are made.

The hinge spring 54 is a spring unit in a leaf spring shape which draws the hinge shaft 53 toward the main body 35 side and presses the hinge shaft 53 against the inner peripheral surfaces of the main body hinge holes and the inner peripheral surfaces of the door hinge holes. This hinge spring 54 comes into contact with the hinge shaft 53 between the first main body hinge hole 51A and the second main body hinge hole 52B, and the hinge spring 54 applies an elastic force to the hinge shaft 53.

Therefore, when the opening and closing door 40 is closed, the hinge spring 54 functions as a spring unit which applies an elastic force in a direction to increase the contact surface pressure between the first and second main body side contact portions 30B and 30C and the opening and closing door 40 (door frame 41).

In this embodiment, when the long diameter direction of the second main body hinge hole 51B coincides with the horizontal direction and the opening and closing door 40 is closed, the long diameter direction of the door hinge holes and the long diameter direction of the second main body hinge hole 51B are substantially orthogonal to each other, so that in the state that the opening and closing door 40 is closed, the long diameter direction of the door hinge holes substantially coincides with the vertical direction (see FIG. 5 and FIG. 6).

At this time, when a force to draw the hinge shaft 53 to the main body frame 30 side is applied from the opening and closing door 40 side, the hinge shaft 53 cannot be displaced toward the short diameter side of the door hinge holes. Therefore, the opening and closing door 40 (door frame 41) tries to move to the main body frame 30 side along the horizontal direction that is the long diameter direction of the second main body hole 51B according to the elastic force of the hinge spring 54, so that the contact surface pressure between the first and second main body side contact portions 30B and 30C and the opening and closing door 40 (door frame 41) increases.

1-6. Lock Mechanism (see FIG. 3, FIG. 4, and FIG. 12)

The lock mechanism 60 is for holding a state that the opening and closing door 40 is closed. This lock mechanism 60 is provided at a position deviated to the center from the hinge mechanism 50 in a direction (left and right direction in FIG. 12) parallel to the hinge shaft 53 on the opposite side (upper side of the opening 3A) of the hinge mechanism 50 across the second guide mechanism 22 as shown in FIG. 12.

As shown in FIG. 4, the lock mechanism 60 holds a closed state of the opening and closing door 40 by applying a holding force for relatively drawing the opening and closing door 40 toward the main body 35 to the opening and closing door 40 and the main body 35 by engaging an engagement arm 61 provided on the opening and closing door 40 and an engagement projection 62 provided on the main body frame 30 (main body 35) side The engagement arm 61 is a hook-shaped arm member which has a root side swingably fitted to the door frame 41, a tip end side extending to the main body frame 30 side, and has a protruding portion 61B on the tip end side. The protruding portion 61B has an inclined surface 61A which is inclined with respect to the vertical direction.

The inclined surface 61A is inclined with respect to the vertical direction so that its upper end side is positioned closer to the tip end side (left side in FIG. 4) of the engagement arm 61 than the lower end side, and its inclination angle is substantially 45 degrees in this embodiment.

An arm side guide surface 61C, which comes into contact with a projection side guide surface 62A while sliding on the engagement projection 62 when the engagement arm 61 is engaged with the engagement projection 62, is provided on the further tip end side of the engagement arm 61 than the inclined surface 61A. This arm side guide surface 61C is inclined with respect to the vertical direction so that its upper end side comes closer to the root side of the engagement arm 61 than the lower end side.

On the other hand, the engagement projection 62 is positioned at a further upper side than the inclined surface 61A and comes into contact with the inclined surface 61A from the upper side and engages with the projection 61B of the engagement arm 61. In this engagement projection 62, the projection side guide surface 62A is provided in the range from the apex 62A that comes into contact with the inclined surface 61A to the root side of the engagement arm 61. The projection side guide surface 62A inclines with respect to the vertical direction so that its upper end side comes closer to the root side of the engagement arm 61 than the lower end side.

A coil spring 63 is a spring unit which applies an elastic force in a direction of increasing the contact surface pressure between the inclined surface 61A and the engagement projection 62 to the engagement arm 61. In this embodiment, the elastic force of the coil spring 63 is applied to the engagement arm 61 at a position closer to the root side of the engagement arm 61 than the contact portion between the inclined surface 61A and the engagement projection 62.

In the state that the engagement arm 61 and the engagement projection 62 engage with each other, as shown in FIG. 4, the engagement arm 61 applies a horizontal component $F_1$ and a vertical component $F_2$ of a reactive force $F_0$ applied from the engagement projection 62 to the door frame 41 (opening and closing door 40). Due to the horizontal component $F_1$, the contact surface pressure between the first and second main body side contact portions 30B and 30C and the opening and closing door 40 (door frame 41) is increased, and due to the vertical component $F_2$ and the gravity applied to the opening and closing door 40, the contact surface pressure between the vertical positioning portion and the contact surface increases.

2. Features of Laser Printer 1 of this Embodiment

In this embodiment, the second main body hinge hole 51B is larger than the first main body hinge hole 51A, so that by this second main body hinge hole 51B, dimensional variation between the opening and closing door 40 and the main body 35 can be effectively absorbed. On the other hand, the first main body hinge hole 51A is smaller than the second main body hinge hole 51B, so that the displacement (movement) of the opening and closing door 40 is restricted by this first main body hinge hole 51A, and the opening and closing door 40 is suppressed from greatly warping.

The problem described above can be solved by sufficiently increasing the rigidity of the opening and closing door 40, however, this solution makes the opening and closing door 40 heavy and results in an increase in manufacturing cost of the opening and closing door 40.

On the other hand, in this embodiment, as described above, the increase in weight and the manufacturing cost increase for the opening and closing door 40 are suppressed by a simple solution which makes the first main body hinge hole 51A smaller than the second main body hinge hole 51. And the dimensional variation between the opening and closing door 40 and the main body 35 is absorbed by the above solution. And the opening and closing door 40 can be suppressed from greatly warping.

In this embodiment, the hinge spring 54 applies an elastic force to the hinge shaft 53 at a position deviated to the second main body hinge hole 51B side from the central portion between the first main body hinge hole 51A and the second main body hinge hole 51B as shown in FIG. 16. Therefore, the hinge shaft 53 cannot be evenly pressed against the inner peripheral surface of the first main body hinge hole 51A and the inner peripheral surface of the second main body hinge hole 51B.

Combined with the arrangement of the lock mechanism 60 and the hinge mechanism 50 deviated from each other, a bending moment is easily applied to the opening and closing door 40 (door frame 41).

Therefore, the bending moment to be applied to the opening and closing door 40 is relaxed by applying the elastic force of the hinge spring 54 to the central portion between the first main body hinge hole 51A and the second main body hinge hole 51B. And, warping of the opening and closing door 40 can be reduced.

In FIG. 16, the diameter of the first main body hinge hole 51A is drawn to be twice the diameter of the hinge shaft 53, so that the door hinge plate 52 greatly tilts with respect to the main body hinge plate 51. However, in actuality, the diameter of the first main body hinge hole 51A and the diameter of the hinge shaft 53 are substantially the same to an extent allowing the hinge shaft 53 to rotate in a sliding manner, so that the door hinge plate 52 does not greatly tilt with respect to the main body hinge plate 51.

However, according to arrangement of equipment other than the hinge spring 54, in the present situation, the elastic force of the hinge spring 54 cannot be applied to the central portion between the first main body hinge hole 51A and the second main body hinge hole 51B.

On the other hand, as in the case of the above-described embodiment, the opening and closing door 40 can be suppressed from greatly warping by making the first main body hinge hole 51A close to the lock mechanism 60 smaller than the second main body hinge hole 51B. When the elastic force of the hinge spring 54 cannot be applied to the central portion between the first main body hinge hole 51A and the second main body hinge hole 51B, application of this embodiment is especially effective.

In this embodiment, the hinge spring 54 applies an elastic force to the portion between the first main body hinge hole 51A and the second main body hinge hole 51B of the hinge shaft 53, and the first main body hinge hole 51A is provided closer to the lock mechanism 60 than the second main body hinge hole 51B.

Therefore, the first main body hinge hole 51A is positioned between a point to which the hinge spring 54 applies an elastic force and a point to which the lock mechanism 60 applies a holding force. It is highly possible that the opening and closing door 40 warps so that the portion provided with the first main body hinge hole 51A is most greatly displaced.

However, in this embodiment, the first main body hinge hole 51A positioned between the two points of application of the forces is set to be smaller than the second hinge hole 51B, so that the displacement of the opening and closing door 40 is effectively restricted, and the opening and closing door 40 is suppressed from greatly warping.

In this embodiment, the first main body hinge hole 51A and the second main body hinge hole 51B are made in the main body 35, and the second main body hinge hole 51B is formed into a slot long in diameter in the horizontal direction, and the long diameter direction of the second main body hinge hole 51B and the long diameter direction of the door hinge holes are substantially orthogonal to each other in the state that the opening and closing door 40 is closed. Therefore, when the opening and closing door 40 is opened and becomes substantially horizontal, the longitudinal directions of the door hinge holes (52A and 52B) made in the opening and closing door 40 and the second main body hinge hole 51B made in the main body 35 are both substantially horizontal.

Therefore, vertical rattling of the opening and closing door 40 is restricted in the state that the opening and closing door 40 is opened. And, when the opening and closing door 40 is opened, a user hardly feels the rattling of the opening and closing door 40. The feeling when the user opens the opening and closing door 40 can be improved.

When the opening and closing door 40 is closed, the long diameter direction of the door hinge holes (52A and 52B) made in the opening and closing door 40 and the long diameter direction of the second main body hinge hole 51B made in the main body 35 are substantially orthogonal to each other, so that by displacement of the opening and closing door 40, fitting dimensional variation of the opening and closing door 40 with respect to the main body 35 can be absorbed.

As described above, in this embodiment, it is not necessary to increase the rigidity of the door frame 41, and the rigidity of the door frame 41 can be made smaller than that of the main body frame 30. Therefore, while the manufacturing cost increase of the opening and closing door 40 is suppressed, the dimensional variation between the opening and closing door 40 and the main body 35 is absorbed, and the opening and closing door 40 can be suppressed from greatly warping.

In this embodiment, the opening and closing door 40 can be suppressed from greatly warping, so that even when the opening and closing door 40 is provided with a conveying chute 22C and a registration roller 22A, negative influences on the conveying chute 22C and the registration roller 22A can be suppressed.

In this embodiment, positioning portions (first main body side contact portion 30B and second main body side contact portion 30C, etc.), which come into contact with the opening and closing door 40 in the closed state of the opening and closing door 40 and positions the opening and closing door 40 with respect to the main body member 35, are provided on the main body 35. Therefore, while the conveying chute 22C and the registration roller 22A are accurately positioned with respect to the main body member 35, the dimensional variation between the opening and closing door 40 and the main body member 35 is absorbed, and the opening and closing door 40 can be suppressed from greatly warping.

Other Embodiments

In the above-described embodiment, hinge holes are made in the hinge plates 51 and 52, however, the present invention is not limited to this, and for example, it is also allowed that the hinge holes are made only in the main body hinge plate 51, and the hinge shaft 53 is fixed to the door hinge plate 52. On the contrary, it is also allowed that the hinge holes are made only in the door hinge plate 52, and the hinge shaft 53 is fixed to the main body hinge plate 51.

In the embodiment described above, the hinge spring 54 is provided on the main body 35 side, however, the present invention is not limited to this, and the hinge spring 54 may be provided on the opening and closing door 40.

In the embodiment described above, the second main body hinge hole 51B is formed so that its long diameter direction coincides with the horizontal direction, however, the present invention is not limited to this, and for example, it is also allowed that the long diameter direction of the second main body hinge hole 51B is made coincident with the vertical direction, or that the second main body hinge hole 51B is formed into a circular hole with a diameter larger than the first main body hinge hole 51A.

In the embodiment described above, the door hinge holes are all formed into slots. However, the present invention is not limited to this, and they may be circular holes.

In the above-described embodiment, the main body hinge plate 51 is fixed with P screws to the side frames 31, and on the other hand, the door hinge plate 52 is integrally formed with the post frames 41A. However, the present invention is not limited to this, and for example, it is also allowed that the main body hinge plate 51 is formed integrally with the side frames 31, and a separately-formed door hinge plate 52 is fixed to the post frames 41A.

In the embodiment described above, the hinge spring 54 comes into contact with the hinge shaft 53 and directly applies an elastic force to the hinge shaft 53. However, the present invention is not limited to this, and the elastic force may be indirectly applied to the hinge shaft 53.

In the embodiment described above, only the two hinge holes formed in the main body hinge plate 51 are made different in size from each other. However, the present invention is not limited to this, and it is also allowed that only the two hinge holes formed in the door hinge plate 52 are made different in size from each other, or hinge holes of both the main body hinge plate 51 and the door hinge plate 52 are made different in size between the sides close to and distant from the lock mechanism 60.

The present invention is not limited to the above-described embodiments as long as it is consistent with the spirit of the invention described in claims.

What is claimed is:

1. An image forming apparatus comprising:

an image forming unit which forms an image on a recording medium;

a main body member which includes a main body frame supporting the image forming unit and a casing covering the main body frame, and houses the image forming unit;

a door member for opening and closing an opening provided in the main body member;

a hinge mechanism which joins the door member swingably with respect to the main body member; and a lock mechanism which is provided at a position deviated from the hinge mechanism and hold a state that the door member is closed, wherein the hinge mechanism includes;

a first hinge hole and a second hinge hole which are provided in at least one of the door member and the main body member, and are arranged substantially coaxially while being spaced from each other, a hinge shaft inserted across the first hinge hole and the second hinge hole, and a spring unit which presses the hinge shaft against inner peripheral surfaces of the first and second hinge holes, and furthermore, the first hinge hole is smaller in size than the second hinge hole.

2. The image forming apparatus according to claim 1, wherein the spring unit applies an elastic force to a portion of the hinge shaft between the first hinge hole and the second hinge hole, and furthermore, the first hinge hole is provided closer to the lock mechanism than the second hinge hole.

3. The image forming apparatus according to claim 2, wherein the first hinge hole and the second hinge hole are provided in the main body member, the second hinge hole is formed into a slot shape long in diameter in the horizontal direction, and in the door member, a slot is formed into which the hinge shaft is inserted and which are long in diameter in a direction orthogonal to the long diameter direction of the second hinge hole in a state that the door member is closed.

4. The image forming apparatus according to claim 1, wherein the rigidity of the door frame forming at least a part of the door member is smaller than that of the main body frame.

5. The image forming apparatus according to claim 1, wherein the door member is provided with a conveying chute which guides conveyance of recording medium.

6. The image forming apparatus according to claim 1, wherein the door member is provided with a registration roller which controls the conveying direction of recording medium.

7. The image forming apparatus according to claim 5, wherein the main body member is provided with a positioning portion which comes into contact with the door member in a state that the door member is closed and positions the door member with respect to the main body member.

* * * * *